US008544900B2

(12) United States Patent
Elbrecht et al.

(10) Patent No.: US 8,544,900 B2
(45) Date of Patent: Oct. 1, 2013

(54) TOOL OPERATED CHANNEL LATCH

(75) Inventors: Steven P. Elbrecht, Long Beach, CA (US); James R. Hernandez, Anaheim, CA (US)

(73) Assignee: Hartwell Corporation, Placentia, CA (US)

( * ) Notice: Subject to any disclaimer, the term of this patent is extended or adjusted under 35 U.S.C. 154(b) by 355 days.

(21) Appl. No.: 12/865,335

(22) PCT Filed: Feb. 2, 2009

(86) PCT No.: PCT/US2009/032884

§ 371 (c)(1),
(2), (4) Date: Dec. 22, 2010

(87) PCT Pub. No.: WO2009/100030

PCT Pub. Date: Aug. 13, 2009

(65) Prior Publication Data

US 2011/0101710 A1 May 5, 2011

Related U.S. Application Data

(60) Provisional application No. 61/025,294, filed on Jan. 31, 2008.

(51) Int. Cl.
*E05C 3/04* (2006.01)
*B65D 45/30* (2006.01)

(52) U.S. Cl.
USPC 292/202; 292/100; 292/256.69; 292/DIG. 49

(58) Field of Classification Search
USPC ..... 292/100, 113, 126, 200, 202, 226, 292/256.69, DIG. 49
See application file for complete search history.

(56) References Cited

U.S. PATENT DOCUMENTS

| | | | | |
|---|---|---|---|---|
| 3,201,960 | A * | 8/1965 | Berkowitz | 70/150 |
| 3,393,539 | A * | 7/1968 | Gehrie | 70/71 |
| 3,622,189 | A * | 11/1971 | Rosehitz et al. | 292/240 |
| 4,116,479 | A * | 9/1978 | Poe | 292/113 |
| 4,510,779 | A | 4/1985 | Ahad | |
| 4,693,503 | A * | 9/1987 | Bisbing | 292/210 |
| 5,609,373 | A * | 3/1997 | Gromotka | 292/229 |
| 5,638,709 | A * | 6/1997 | Clavin | 70/208 |
| 5,664,813 | A * | 9/1997 | Gromotka | 292/229 |
| 5,984,382 | A * | 11/1999 | Bourne et al. | 292/113 |
| 6,036,238 | A * | 3/2000 | Lallament | 292/100 |
| 6,279,971 | B1 * | 8/2001 | Dessenberger, Jr. | 292/113 |
| 6,513,841 | B1 * | 2/2003 | Jackson | 292/214 |
| 6,606,889 | B1 | 8/2003 | Tweedy | |
| 7,185,926 | B2 | 3/2007 | Helsley et al. | |

OTHER PUBLICATIONS

International Search Repot & Written Opinion issued in app. No. PCT/US09/32884 (2009).

* cited by examiner

*Primary Examiner* — Carlos Lugo
(74) *Attorney, Agent, or Firm* — Barnes & Thornburg LLP

(57) ABSTRACT

A latch mechanism for releasably latching or holding a first member with respect to a second member in a structure. The latch mechanism includes a bolt assembly, mounting brackets, and a locking trigger. The latch mechanism also includes a rotatable locking cam for providing retention of the bolt assembly in a latched or locked condition.

13 Claims, 8 Drawing Sheets

TOOL OPERATED CHANNEL LATCH

CROSS REFERENCE TO RELATED APPLICATIONS

This patent application is a U.S. nationalization under 35 U.S.C. §371 of International Application No. PCT/US2009/032884, filed Feb. 2, 2009, which claims the benefit of priority under 35 U.S.C. §119(e) to U.S. Provisional Application Ser. No. 61/025,294, filed Jan. 31, 2008. The disclosures set forth in the referenced applications are incorporated herein by reference in their entireties, including all information as originally submitted to the United States Patent and Trademark Office.

BACKGROUND

The present disclosure relates to a latch mechanism for releasably latching or holding a first member with respect to a second member in a structure. The latch mechanism includes a bolt assembly, mounting brackets, and a locking trigger. The latch mechanism also includes a rotatable locking cam for providing retention of the bolt assembly in a latched or locked condition.

BRIEF DESCRIPTION OF THE DRAWINGS

The present disclosure will be described hereafter with reference to the attached drawings which are given as a non-limiting example only, in which.

Figure 1:
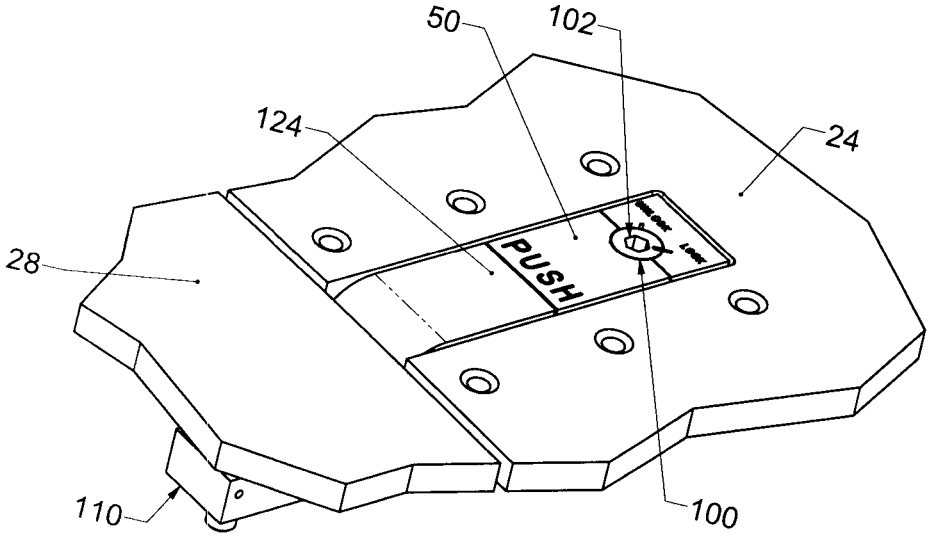
FIG. 1 is a perspective view of the latch assembly installed in a structure, as viewed from above the structure.

The exemplification set out herein illustrates embodiments of the disclosure that is not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure and is not intended to be exhaustive or to limit the disclosure to the details of construction and the arrangements of components set forth in the following description or illustrated in the drawings.

Figure 2:
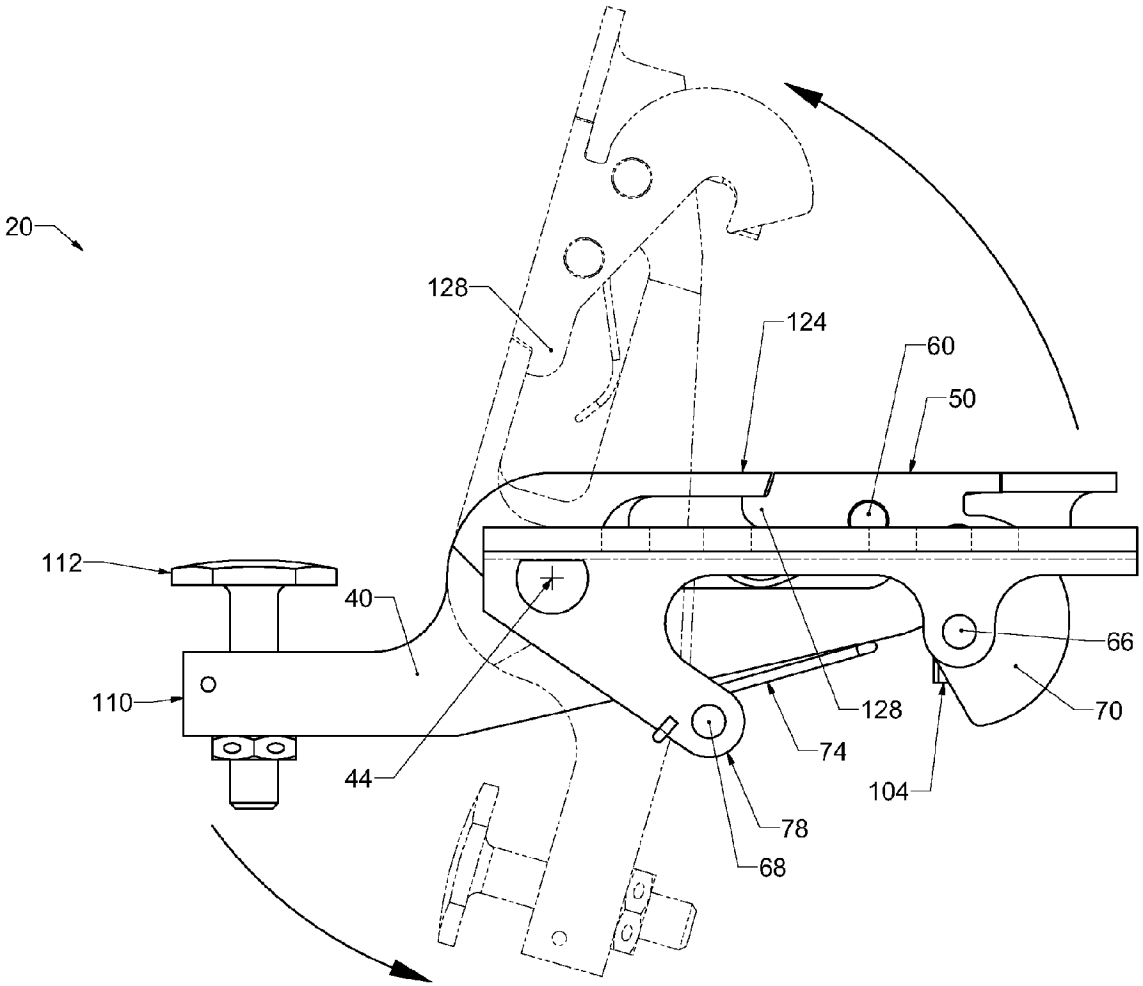
FIG. 2 is a side elevational view showing the latch in a closed and in an open position.
Figure 3:
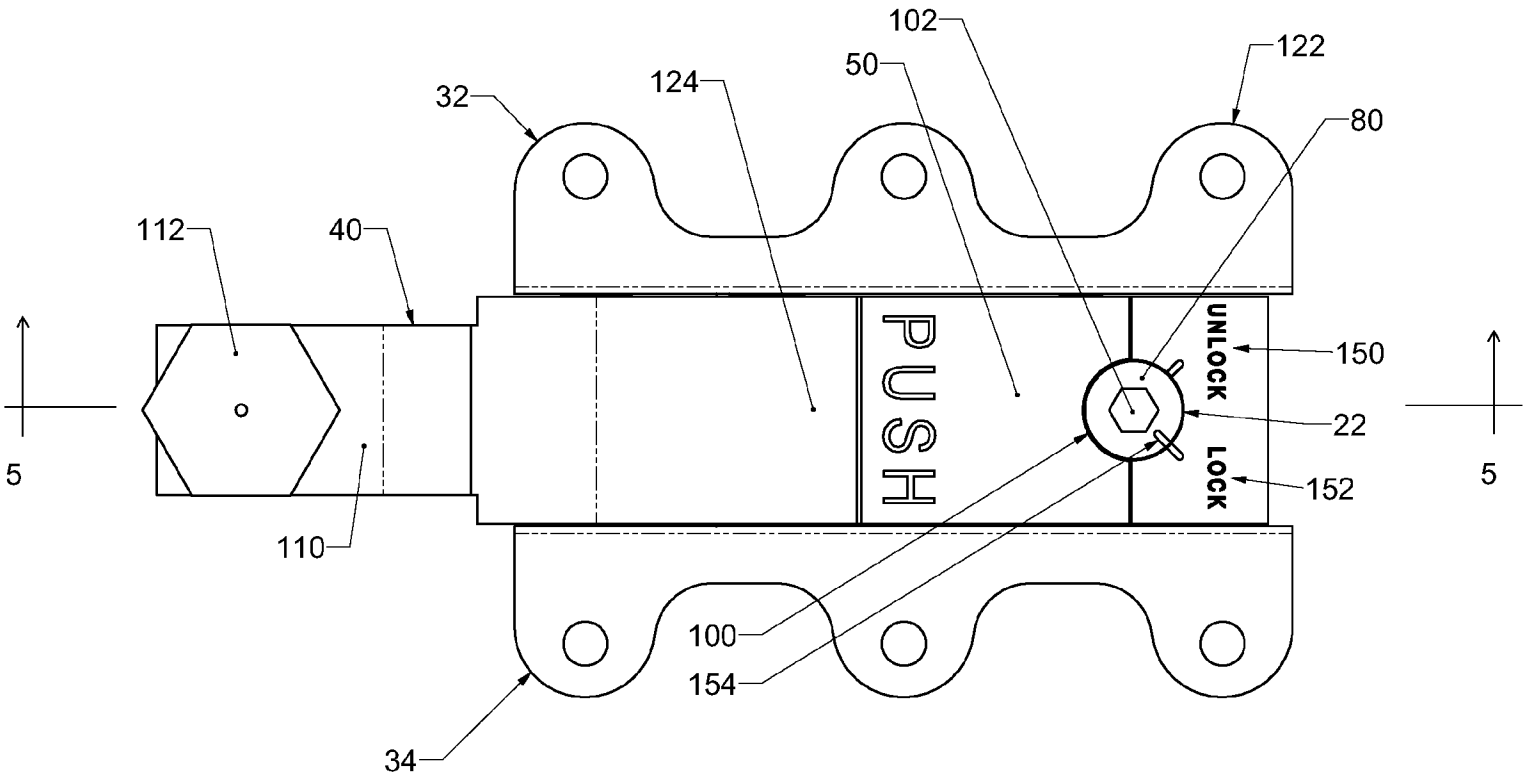
FIG. 3 is a top plan view.
Figure 9:
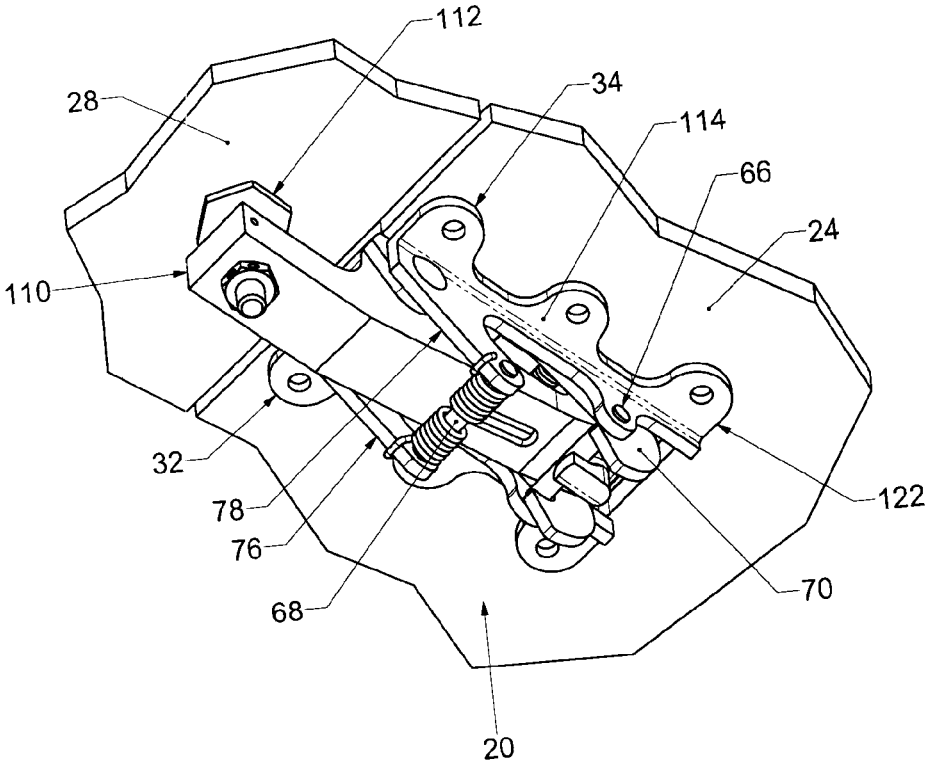
FIG. 9 is a perspective view of the latch assembly as shown in FIG. 1 installed in a structure, as viewed from below the structure.

As shown in FIGS. 1 and 9, disclosed is a latch mechanism 20 configured for latching a first member 24 to a second member 28 in a structure such as might be used on an aircraft structure. The latch mechanism 20 includes a pair of brackets 32, 34 for attaching the latch 20 to the first member 24. A bolt assembly 40 is pivotally carried on a pin 44 and bushing 48 secured to and extending between the bracket portions 32, 34. As shown in FIG. 2 and with reference to FIGS. 1 and 9, the assembly can pivot about the pin 44 to allow disengagement of the first member 24 from the second member 28, to which the assembly is secured by the brackets 32, 34.

With reference to FIGS. 1-9, a trigger 50 is carried on the bolt 40 by means of pin 54 extending through the trigger and bushing 58. A second pin 60 extends through the trigger 50 to retain the biasing spring 64 in association with the trigger 50 and acting against the bolt 40. Additional pins 66, 68, are engaged on and extend between the brackets 32,34. Pin 66 is positioned for engagement by the hook ends 70 of the trigger 50. Pin 68 extends through a biasing spring 74 which is retained on downwardly extending portions 76, 78 of the brackets 32,34 to which the pin 68 is attached. The spring 74 biases against the bolt 40 to urge the bolt 40 in an upward or open position.

With reference to the Figures, a generally cylindrical locking cam 80 is carried on the bolt 40, extending through a bore 84 in the bolt 40. The cam 80 is retained in the bore 84 by interference engagement of the bushing 58 and the corresponding groove or notch 130 on the body of the cam 80. A return spring 94 is positioned around an upper portion 98 of the cam 80 with a first end attached to the upper portion 98 of the cam 80. A second end is attached to the bolt 40 to provide an axial rotary return.

The upper portion 98 of the cam 80 extends from the bore 84 and a corresponding opening 100 on the trigger 50. This allows access by a tool to the drive opening 102 in the cam which is generally flush with the surface of the trigger 50. Engagement of the cam head drive opening 102 with a tool allows the cam 80 to be rotated thereby locking or unlocking an extending finger 104 of the cam with the pin 66. This locking feature 79, including cam 80 integrated in the bolt 40 and the corresponding pin 66, prevents the latch 20 from being opened or closed without a tool engaged in the drive opening 102. This makes the latching mechanism more resistant to tampering and human error (leaving the latch unlocked) than prior designs.

Figure 5:
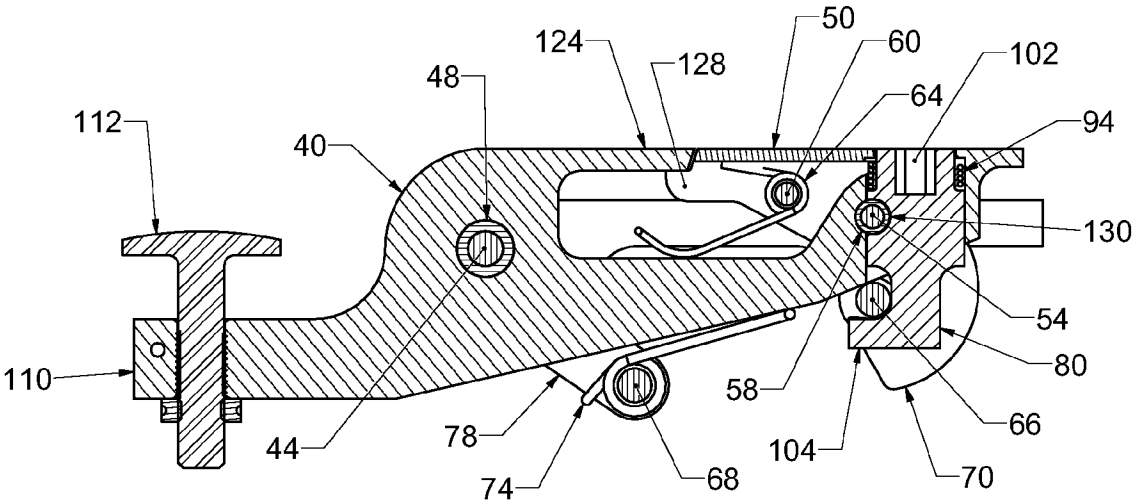
FIG. 5 is a cross-sectional view taken along lines 5-5 in FIG. 3.

In use, the assembled latch mechanism 20 is retained on the first member 24. This provides a latching action of the extending portion 110 of the bolt 40 and the adjustable threaded stop portion 112 attached thereto against the second portion 28. In other words, in the closed latch configuration, see FIGS. 1, 5 and 9, the primary portion 114 of the latch is attached is to the first member 24 with the extending portion 110 and adjustable body 112 engaging a corresponding underside of the second member 28. The extending portion 122 of the brackets 32, 34 provide attachment sites to attach the brackets 32,34 to the first portion 24. FIGS. 1, 5 and 9 show the closed, locked configuration with the trigger 50 engaging an extending lip 124 of the bolt. Protruding portions 128 of the trigger engaged underneath the lip 124. Even if the trigger is actuated, the latch will not open unless the cam 80 is rotated with a tool to the "unlocked" position. When the cam 80 is rotated to the unlocked position the latch will not open unless the trigger is actuated to disengage the hooks 70 from the pin 66. The drive opening 102 end of the cam 80 extends through the opening 100 and a corresponding opening 22 on the bolt.

Figure 6:
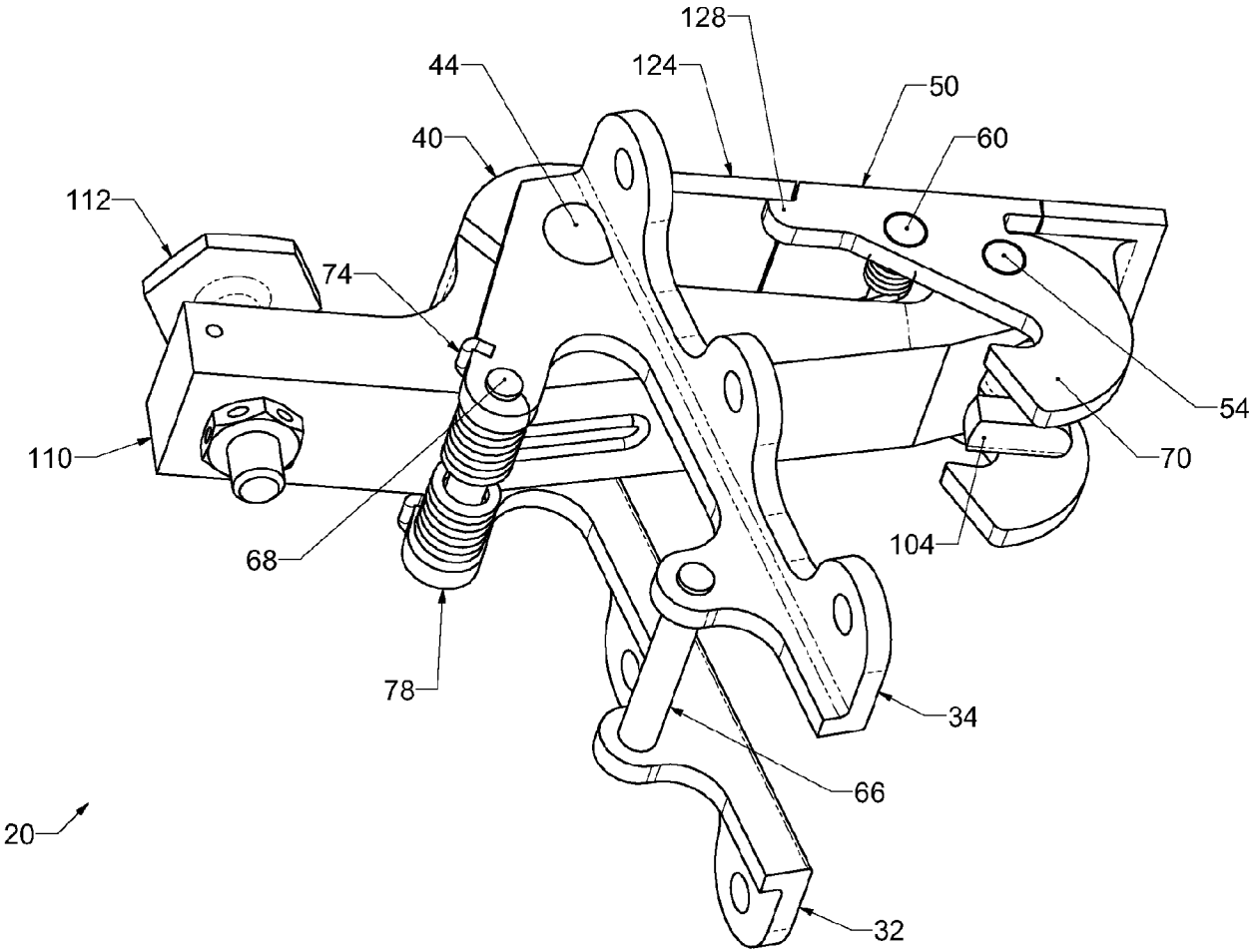
FIG. 6 is a perspective view of the latch assembly as viewed from below showing the bolt rotated relative to the brackets.
Figure 8:
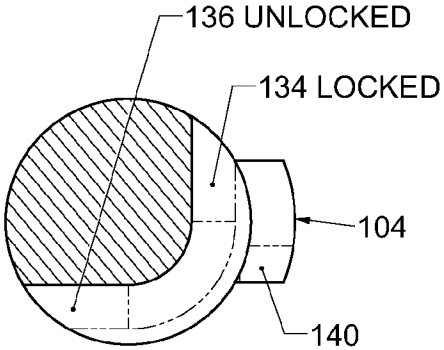
FIG. 8 is a cross-sectional view taken along lines 8-8 in FIG. 7 showing the locked and unlocked positions of the locking cam.

As shown in FIG. 6, the bolt 40 has been rotated about the pin 44 relative to the brackets 32, 34. As shown in this view, the extending or protruding finger 104 is shown in the "locking" position. The locking position orients the finger 104 towards the pin 66. It should be noted that the cam 80 is rotated 90° to unlock the bolt from the pin 66. Also, shown in FIG. 6 is the engagement of the protruding portion 128 of the trigger 50 engaged underneath the edge of the lip 124.

Figure 4:
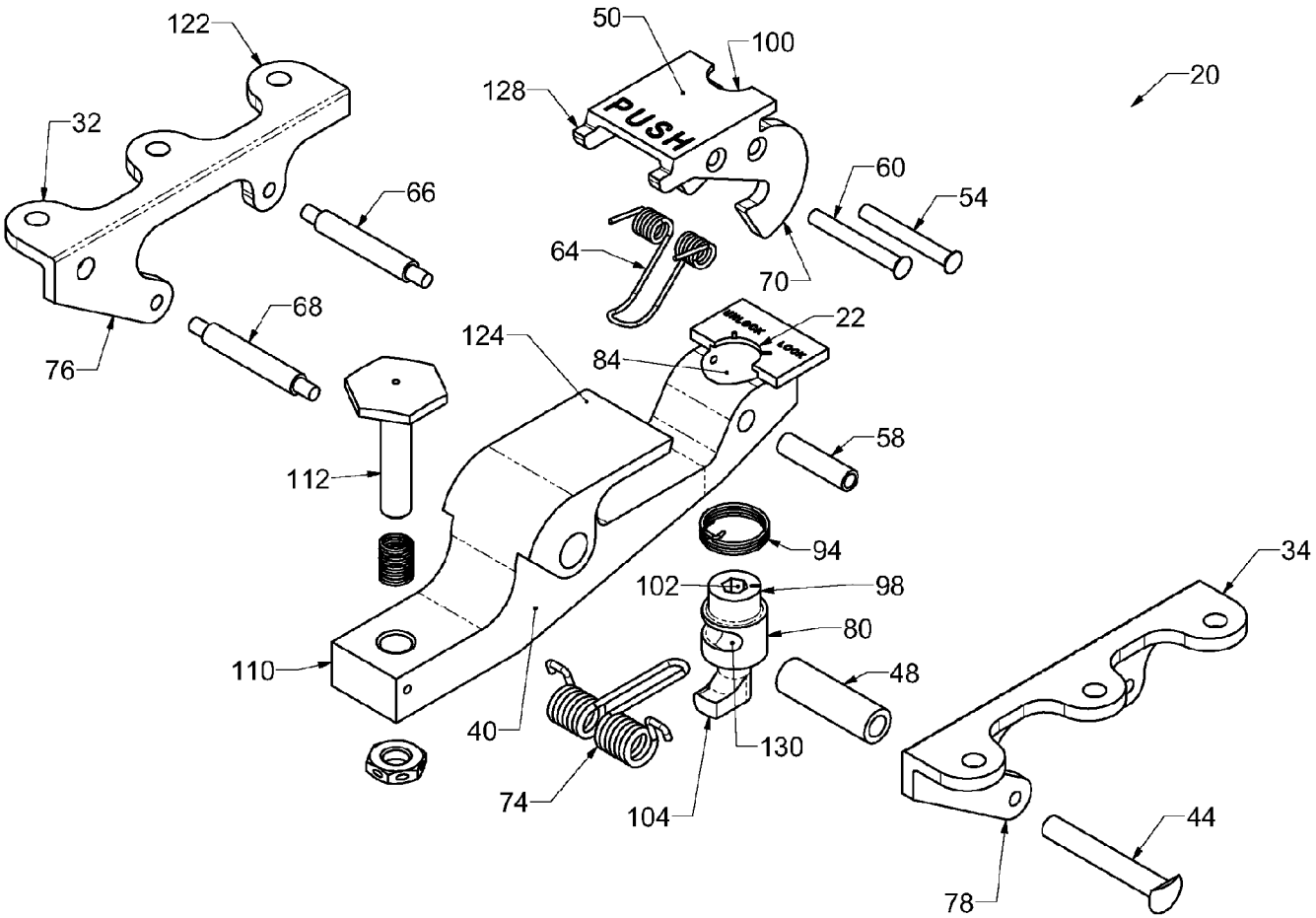
FIG. 4 is an exploded perspective view.
Figure 7:
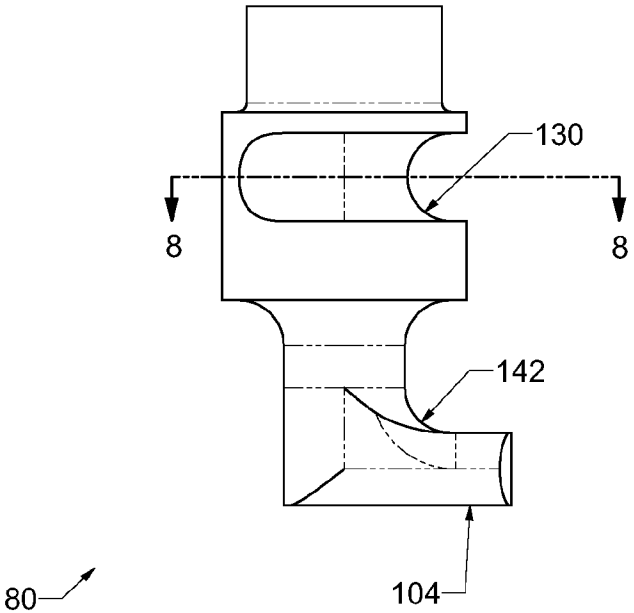
FIG. 7 is an enlarged elevational view of the cam removed from the latch assembly showing the extending finger portion and the curved generally angled groove of the locking cam of the latching mechanism.

Turning to FIG. 7, shown is an enlarged elevational view showing the extending finger portion 104 and the curved, generally angled groove 130 of the locking cam 30 of the latching mechanism 20. This view shows the protruding or extending finger portion 104 of the locking cam 80. Also shown is an angular groove 130. The angular groove 130 includes a locked portion 134 and an unlocked portion 136. With reference to FIG. 4 the bearing 58 engages the groove 130. Throughout the generally right angle rotation of the cam 80 the bearing 58 will either engage the locked portion 34 with the finger 104 extending generally parallel to the longitudinal axis of the bolt 40 or along the unlocked portion 136 in which the finger is rotated generally 90° resulting in a generally perpendicular orientation relative to the longitudinal axis of the bolt 40. As shown, a leading edge 140 of the finger 104 is provided with a curved edge. This curved edge helps to facilitate engagement of the finger underneath the pin 66. Similarly, an internal elbow 142 of the finger 104 is provided with a curved edge.

The latch mechanism 20 helps to secure two bodies 24, 28 such as a door or a hatch on an aircraft. The latch mechanism 20 requires a tool such as by engagement with the drive opening 102 in the cam 80. The cam 80 provides a locking feature by way of engagement of the finger 104 with the bushing 48 carried by the pin 44 extending through the portions 78, 76 of the brackets 34, 32. Indicia in the form of the word "unlocked" 150 and "locked" 152 are provided on the latch surface including an indicator 154 to indicate whether the latch is in the "locked" (152) or "unlocked" (150) positions. The indicator 154 aligning with the indicated position, 152, 150. The indicia and the positively oriented locking feature 104, 48 prevent a "false positive" indication that might otherwise lead a ground crew to wrongly assume the latch on the aircraft is secure and ready for flight. The relatively continuous bolt 40 provides significant strength in the assembly with minimal mechanical elements while minimizing weight associated with the latch mechanism 20.

In use, to release the latch 20, a tool must be inserted into the drive opening 102 of the cam 80 and rotated a ¼ turn. The trigger 50 must then be depressed to cause disengagement of the hook 70 from the pin 66. These actions release or disengage the bolt 40 from the locked position. Once unlocked, the bolt 40 can be pivoted about pin or pivot point 44 (see rotation illustrated in FIG. 2) to the position shown in FIG. 6. This rotation disengages the adjustable stop 112 from the door frame or second member 28. It should be noted that the cam 80 is spring loaded by means of the spring 94. One end of the spring 94 engages the bore 84 with another end of the spring engaging the upper portion 98 of the cam 80.

The coil spring 94 attached to the latching mechanism as described is configured to spring load the cam in the "locked" position. Spring loading the cam in a locked position helps maintain the latch in the locked position against vibration and causes the cam 80 to rotate the finger 104 generally parallel to the longitudinal axis of the bolt 40 even when the latch is opened. This provides a safety which causes the finger 104 of the cam 80 to balk against the pin 66 and indicate an open latch condition. The ground crew must then properly orient the cam 80 to engage the finger 104 underneath the pin 66 using a tool and returning the cam to the "locked" 152 position. Additionally, the bolt 40, at least in the area of the cam 80, can be color coordinated to provide a flag so that a prominent color is displayed when the cam 80 balks against the pin 66. This color coordination provides an additional indicator to the ground crew that the latch 20 must be completely closed. Also, in the unlatched position the hook 70 of the trigger 50 will ride on top of the pin 66 to further indicate a disengaged or unlocked position.

While this disclosure has been described as having an exemplary embodiment, this application is intended to cover any variations, uses, or adaptations using its general principles. It is envisioned that those skilled in the art may devise various modifications and equivalents without departing from the spirit and scope of the disclosure as recited in the following claims. Further, this application is intended to cover such departures from the present disclosure as come within the known or customary practice within the art to which it pertains.

The invention claimed is:

1. A latch mechanism for releasably latching a first member with respect to a second member in a structure, the latch mechanism comprising:

a bolt assembly mounted for pivotal movement about a first axis between a first position latching the first member with respect to the second member and a second position wherein the first member is unlatched from the second member;

mounting brackets coupling the bolt assembly to the first member;

a locking trigger carried on the bolt assembly and operable to lock the bolt assembly in the first position; and a locking cam rotatable about a second axis generally perpendicular to the first axis and carried on the bolt assembly for locking the bolt assembly in the first position and for unlocking the bolt assembly a member coupled to the brackets, the member engaging the trigger and engaging the cam in a position locking the bolt assembly in the first position, the member being disengaged from the trigger and cam when the bolt assembly is in the second position.

2. The latch mechanism of claim 1 wherein the member for holding the trigger in the locked position and for retaining the cam in the locked position comprises a pin.

3. The latch mechanism of claim 2 wherein the pin has an axis extending generally parallel to the first axis.

4. The latch mechanism of claim 3 wherein in the locked position the cam engages the pin at substantially the center of the length of the pin.

5. The latch mechanism of claim 3 wherein in the locked position the trigger engages the pin at a first location on one side of the center of the pin and at a second location on the other side of the center of the pin.

6. The latch mechanism of claim 1 wherein the member for holding the trigger in the locked position and for retaining the cam in the locked position is coupled to and spans the brackets.

7. The latch mechanism of claim 1 wherein the member for holding the trigger in the locked position and for retaining the cam in the locked position abuts the trigger in the locked position and abuts the cam in the locked position.

8. The latch mechanism of claim 7 wherein the member for holding the trigger in the locked position and for retaining the cam in the locked position does not abut the trigger in the unlocked position and does not abut the cam in the unlocked position.

9. The latch mechanism of claim 1 wherein the cam includes a finger for engaging the member.

10. The latch mechanism of claim 9 wherein the finger includes a curved leading edge shaped to facilitate engaging the member.

11. The latch mechanism of claim 1 wherein the cam includes a bias mechanism configured to bias the cam to the first position.

12. A method of operation of a latch mechanism for releasably latching or holding a first member with respect to a second member in a structure, the latching comprising the steps of:

providing a latch mechanism with mounting brackets for mounting on a first structure;

providing a bolt assembly operatively carried on the mounting brackets;

providing a locking trigger operatively carried on the bolt assembly;

providing a rotatable locking cam carried on the bolt assembly for providing retention of the bolt assembly in a latched condition;

rotating the bolt assembly to a closed condition and locking the bolt in the closed position by;

engaging a pin of the bolt assembly with the trigger; and rotating the cam to engage the pin of the bolt assembly with the cam and so that the pin holds the cam in the locked position.

13. A latch mechanism in combination with an aircraft structure, the latch mechanism releasably latching or holding a first member of the aircraft structure with respect to a second member of the aircraft structure, the latch mechanism comprising:

mounting brackets attaching the latch mechanism to the first member;

a bolt assembly rotatably carried on the mounting brackets, a leading end of the bolt structure being selectively engageable against the second member, the bolt assembly being mounted for rotation about a first axis between a first position latching the first member with respect to the second member and a second position wherein the first member is unlatched from the second member;

a locking trigger carried on the bolt assembly and configured to lock the bolt assembly in the first position; and a rotatable locking cam carried on the bolt assembly for providing retention of the bolt assembly in a latched condition retaining the first member in the first position;

a member engaging the trigger in the first position and engaging the cam in the first position and operable to be disengaged from the trigger and cam in the second position.

* * * * *